US008921749B1

(12) United States Patent
Scott

(10) Patent No.: US 8,921,749 B1
(45) Date of Patent: Dec. 30, 2014

(54) PERPENDICULAR DRIVE MECHANISM FOR A MISSILE CONTROL ACTUATION SYSTEM

(71) Applicant: The United States of America as Represented by the Secretary of the Navy, Washington, DC (US)

(72) Inventor: Aaron M. Scott, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 56 days.

(21) Appl. No.: 13/938,377

(22) Filed: Jul. 10, 2013

(51) Int. Cl.
*F42B 10/62* (2006.01)
*F42B 10/64* (2006.01)
*F42B 10/00* (2006.01)

(52) U.S. Cl.
CPC ..... *F42B 10/64* (2013.01)
USPC ..... 244/3.27; 244/3.1; 244/3.15; 244/3.21; 244/3.24; 244/3.28

(58) Field of Classification Search
USPC ..... 244/3.1, 3.15, 3.21–3.3
See application file for complete search history.

(56) References Cited

U.S. PATENT DOCUMENTS 4,029,270 A * 6/1977 Niemeier ..... 244/3.21
4,175,720 A * 11/1979 Craig ..... 244/3.28
4,210,298 A * 7/1980 Liberman ..... 244/3.21
4,373,688 A * 2/1983 Topliffe ..... 244/3.24
4,512,537 A * 4/1985 Sebestyen et al. ..... 244/3.21
4,560,121 A * 12/1985 Terp ..... 244/3.28
4,568,039 A * 2/1986 Smith et al. ..... 244/3.15
4,575,025 A * 3/1986 Sadvary et al. ..... 244/3.27
4,651,584 A 3/1987 Brieseck et al.
4,709,877 A * 12/1987 Goulding ..... 244/3.28
4,795,110 A * 1/1989 Lang ..... 244/3.24
5,249,761 A 10/1993 Schroppel
5,975,461 A * 11/1999 Ullrich ..... 244/3.21
6,073,880 A * 6/2000 Voigt et al. ..... 244/3.28
6,474,594 B1 11/2002 Johnson et al.
6,637,699 B2 10/2003 Banks et al.
6,726,147 B1 * 4/2004 Perini et al. ..... 244/3.27
6,827,310 B1 12/2004 Whitham
7,175,131 B2 * 2/2007 Dodu et al. ..... 244/3.24
7,219,579 B2 * 5/2007 Turner ..... 244/3.24
7,246,539 B2 * 7/2007 Turner ..... 244/3.24
7,755,012 B2 7/2010 Mock
7,906,749 B2 * 3/2011 Fjerstad ..... 244/3.24
7,923,671 B1 * 4/2011 Huguenin et al. ..... 244/3.24
8,080,772 B2 12/2011 Geck et al.
8,110,785 B2 * 2/2012 Rastegar et al. ..... 244/3.24
8,513,582 B2 * 8/2013 Rastegar et al. ..... 244/3.24
8,530,809 B2 * 9/2013 Castor et al. ..... 244/3.24
8,624,172 B2 * 1/2014 Sweer ..... 244/3.24
2008/0029641 A1 * 2/2008 Carlson et al. ..... 244/3.24

* cited by examiner

*Primary Examiner* — Bernarr Gregory
(74) *Attorney, Agent, or Firm* — James M. Saunders

(57) ABSTRACT

A perpendicular drive mechanism for a missile control actuation system employs an electric motor and power shaft operatively coupled to a first spur gear. A lead screw is coupled to a second spur gear. The lead screw is oriented parallel to the motor and perpendicular to a central longitudinal axis. The first and second spur gears meshingly engage such that the second spur gear rotates in the opposite direction as the first spur gear. A lead nut threadingly engages with and is configured to move linearly along the central axis of the lead screw. A crank arm is coupled on one end to the lead nut and on the other end to the canard shaft of a canard assembly. As the lead nut moves linearly along the central axis of the lead screw, the crank arm follows the lead nut and causes the canard assembly to actuate.

19 Claims, 14 Drawing Sheets

PERPENDICULAR DRIVE MECHANISM FOR A MISSILE CONTROL ACTUATION SYSTEM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to guided missile control actuation and, more particularly, to drive mechanisms having lead screws perpendicular to a missile body center axis.

Figure 1A:
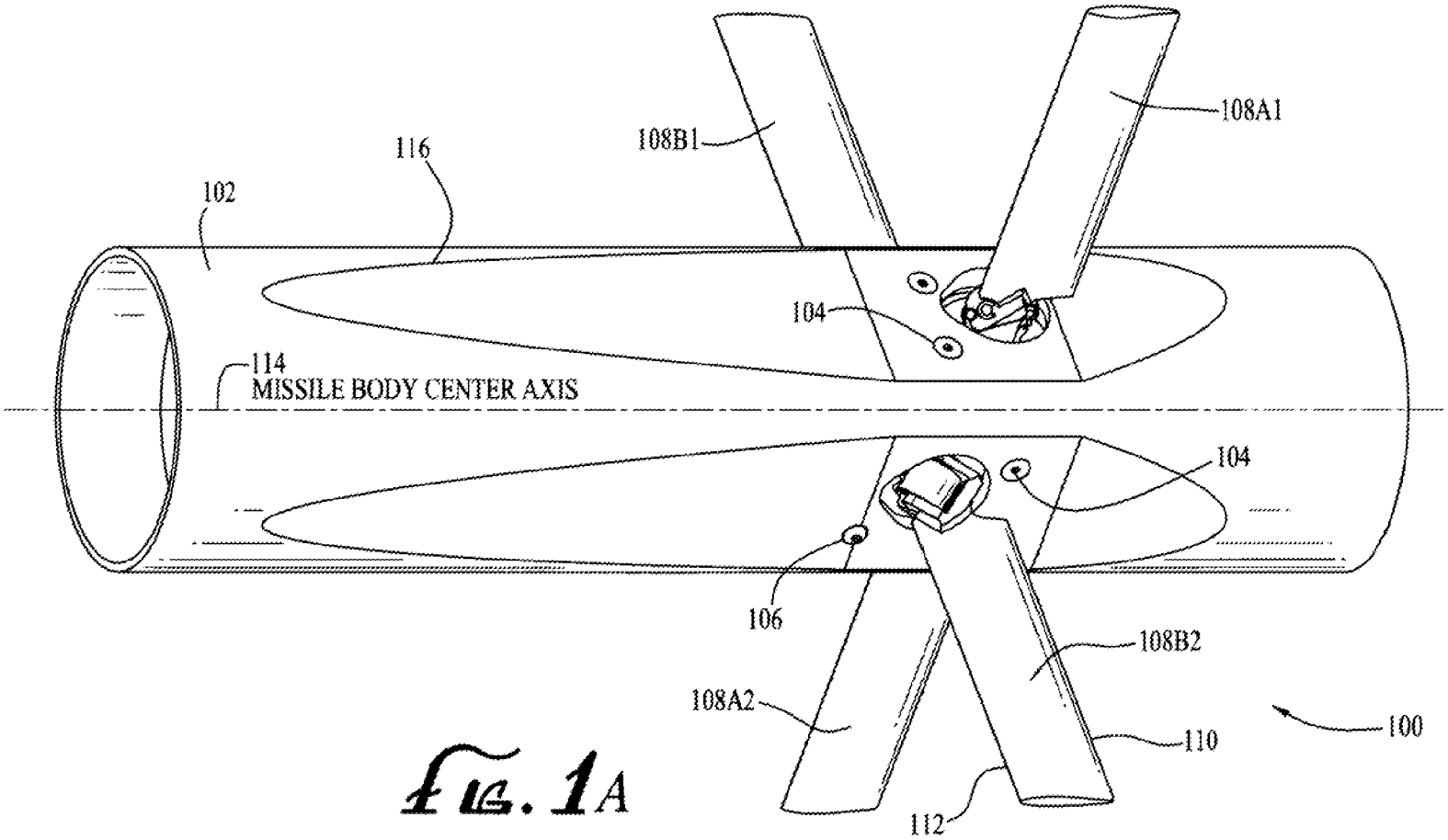
FIG. 1A is an oblique perspective view of the environment (a missile control section), according to some embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

The invention generally relates to guided missile control actuation and, more particularly, to drive mechanisms having lead screws perpendicular to a missile body center axis. Embodiments of the invention provide a solution of substantial improvement to the problem of actuating the aerodynamic control surfaces of a missile or similar guided vehicle. The control actuation system (CAS) drive mechanisms described herein provide improvements that include higher efficiency, lower backlash, more accurate measurement of control surface positions, higher load capacity, and increased ease of assembly.

Embodiments of the invention are particularly well suited for, though not limited to, use on small, low-cost, high-speed, high-precision missiles because it makes optimum use of limited space to (1) withstand relatively large forces generated by aerodynamic loads on control surfaces and (2) provide high torque with high efficiency and low backlash and (3) it accomplishes this with a minimum number of components.

Although embodiments of the invention are described in considerable detail, including references to certain versions thereof, other versions are possible such as, for example, orienting and/or attaching components in different fashion. Therefore, the spirit and scope of the appended claims should not be limited to the description of versions included herein.

In the accompanying drawings, like reference numbers indicate like elements. Reference character 10 and variations thereof such as, for example, 10A1, 10A2, 10B1, and 10B2, are used to depict embodiments of the invention (drive mechanisms). Several views are presented to depict some, though not all, of the possible orientations of embodiments of the invention.

Components used in the apparatus 10, along with their respective reference characters as depicted in several of the figures, include electric motors (direct current—DC) 204, spur gears (206 & 210), lead screws 208, lead nuts 212, crank arms 214, mounting hubs and set screw combinations 304. Also included are ball bearings 218 and 220 (flanged), preload bearing retainers 216, spring pins 306, needle bearings 510 (outer) and 514 (inner), potentiometer circuit boards 502 having potentiometer circuit board contacts 520, potentiometer wiper assemblies 504, preload spring washers 506, ball bearing spacers 508, gaskets/o-rings 516, and potentiometer circuit board mounting bolts/screws 518. The proximal ends of the crank arms 214 have slots 702 that accept integrally-formed pins 704 of the lead nut 212. Components actuated by the drive systems 10 are canard assemblies 108.

The ball bearings 218 and 220 (flanged), needle bearings 510 (outer) and 514 (inner), spring pins 306, and pre-load washers 506, may be steel, stainless steel, or comparable materials. The gaskets/o-rings 516 may be rubber, plastic, or comparable materials. The remaining depicted components may be metal including steel, steel alloys, aluminum alloys, brass, bronze, or comparable materials including plastic.

The canard assemblies are generically referenced using reference character 108 and more specifically referenced to designate them as either aft or forward canard assemblies. Aft canard assemblies are referenced as 108A1 & 108A2 and forward canard assemblies are referenced as 108B1 & 108B2 (all figures excluding FIG. 13). Certain embodiments are directed to single drive mechanisms 10 that actuate a single canard assembly 108, while other embodiments are directed to more than one drive mechanism, which actuate a particular/respective canard assembly (sometimes simply referred to as a canard) in a family of canard assemblies (108A1, A2, B1, & B2). Figures showing close-up views generally depict specific drive mechanisms such as, for example, 10A1, 10A2, 10B1, &10B2.

Operating Environment

Figure 1B:
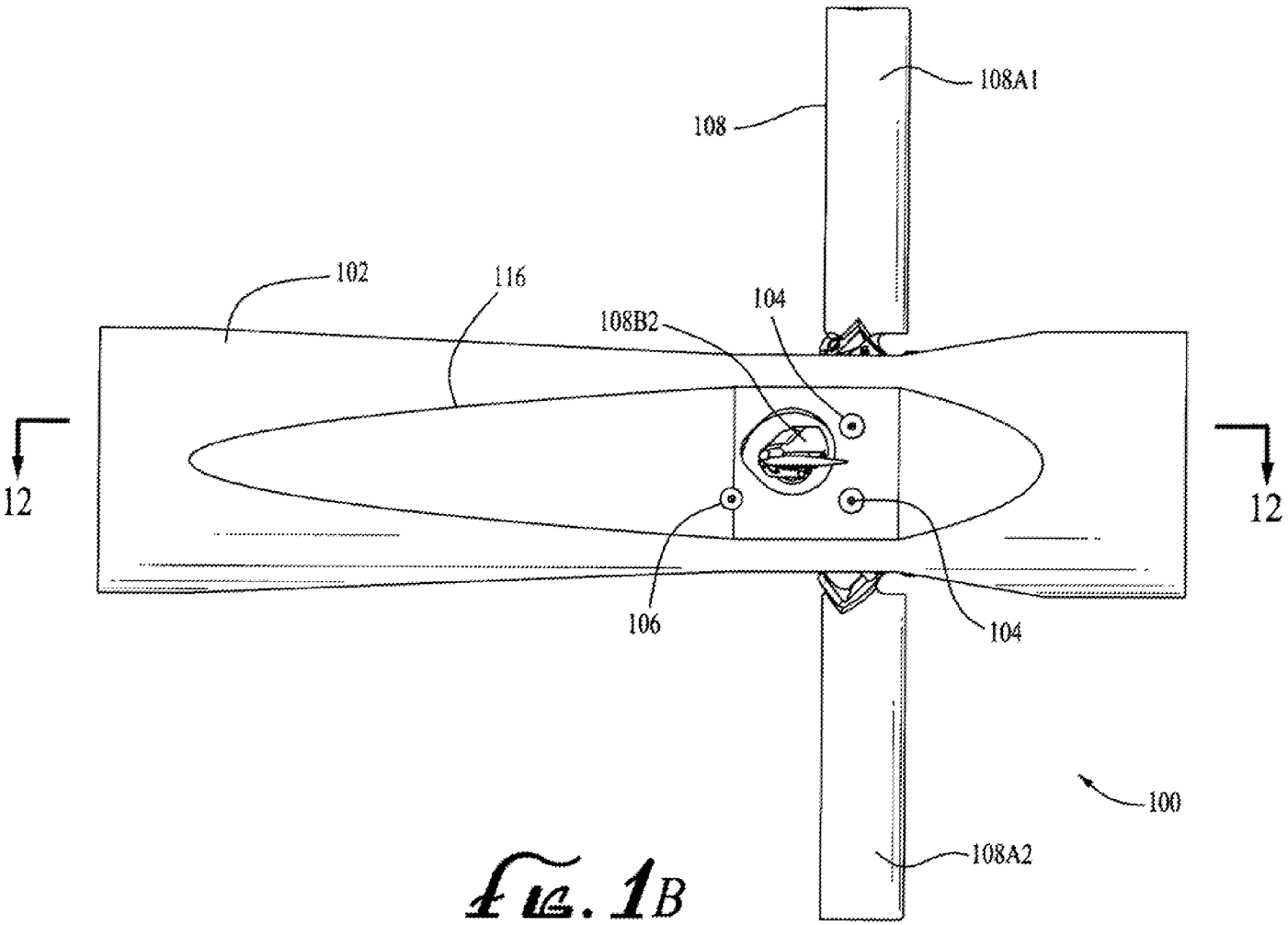
FIG. 1B is a side view of the environment of FIG. 1A, showing cut plane 12-12 (section 12-12 is depicted in FIG. 12), according to some embodiments of the invention.
Figure 12:
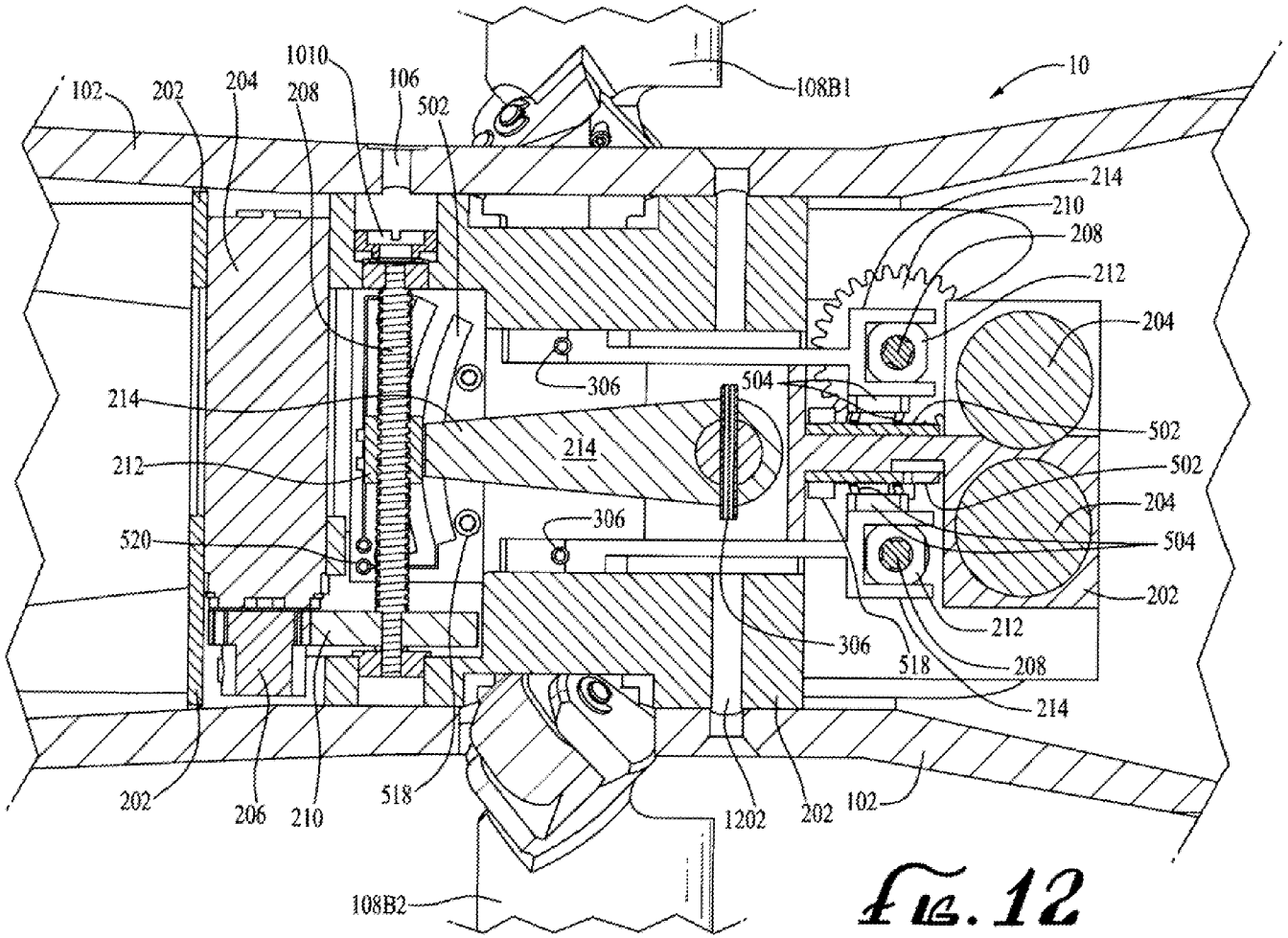
FIG. 12 is a section view perpendicular to cut plane 12-12 of FIG. 1B and through a spring pin access hole, according to some embodiments of the invention.

FIGS. 1A & 1B depict the environment that embodiments of the invention operate in. Specifically, FIG. 1A depicts an oblique perspective view of a missile control section (depicted as reference character 100) of a guided missile. FIG. 1B depicts a side view of the missile control section in FIG. 1A. For purposes of forward and aft directions, a missile body center axis 114 (sometimes referred to as a central longitudinal axis) is used such that longitudinal directions from right to left is selected as "forward" and directions from left to right is selected as "aft." FIG. 1B depicts cut plane 12-12, which goes through one of the spring pin access screws 104. The section view along cut plane 12-12 is shown in FIG. 12.

Both FIGS. 1A & 1B depict the missile control section 100 with a control actuation system (CAS) section skin 102 and canard wells 116. The canard wells 116 are recesses in the CAS section skin 102 that aft canard assemblies 108A1 & 108A2 and forward canard assemblies 108B1 & 108B2 retract to and from. Each of the canard assemblies 108A1, 108A2, 108B1, & 108B2 has both aft 110 and forward 112 edges (shown in FIG. 1A). Although the embodiments shown in the figures present the CAS section skin 102, canard recesses 116, and various canard assemblies (all referenced as 108 or a variation thereof), the depictions are notional and should not be construed as limiting. As such, embodiments of the invention apply to folding canard assemblies, non-folding canard assemblies, and wings or fins, folding or not. As such, the terms canard and canard assembly are used interchangeable throughout. Spring pin access screws 104 and lead screw access screws 106 are depicted. Each of these components and their functions is discussed in greater detail below.

Straddled Embodiments

Figure 3:
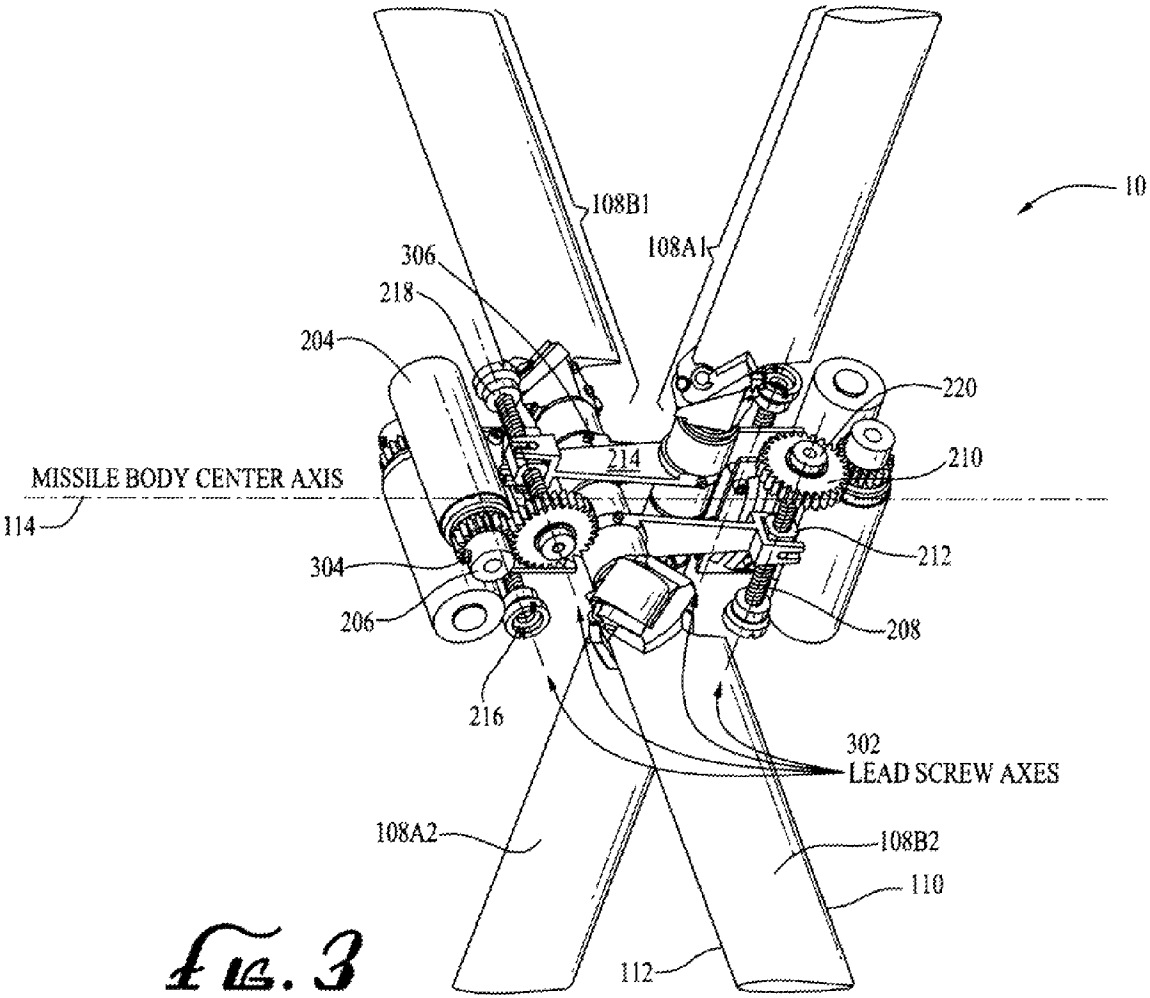
FIG. 3 is an oblique perspective view of a straddled drive mechanism for a control actuation system of a guided missile (shown with the control actuation housing removed) and depicting lead screws oriented perpendicular to the missile body center axis, according to some embodiments of the invention.
Figure 4:
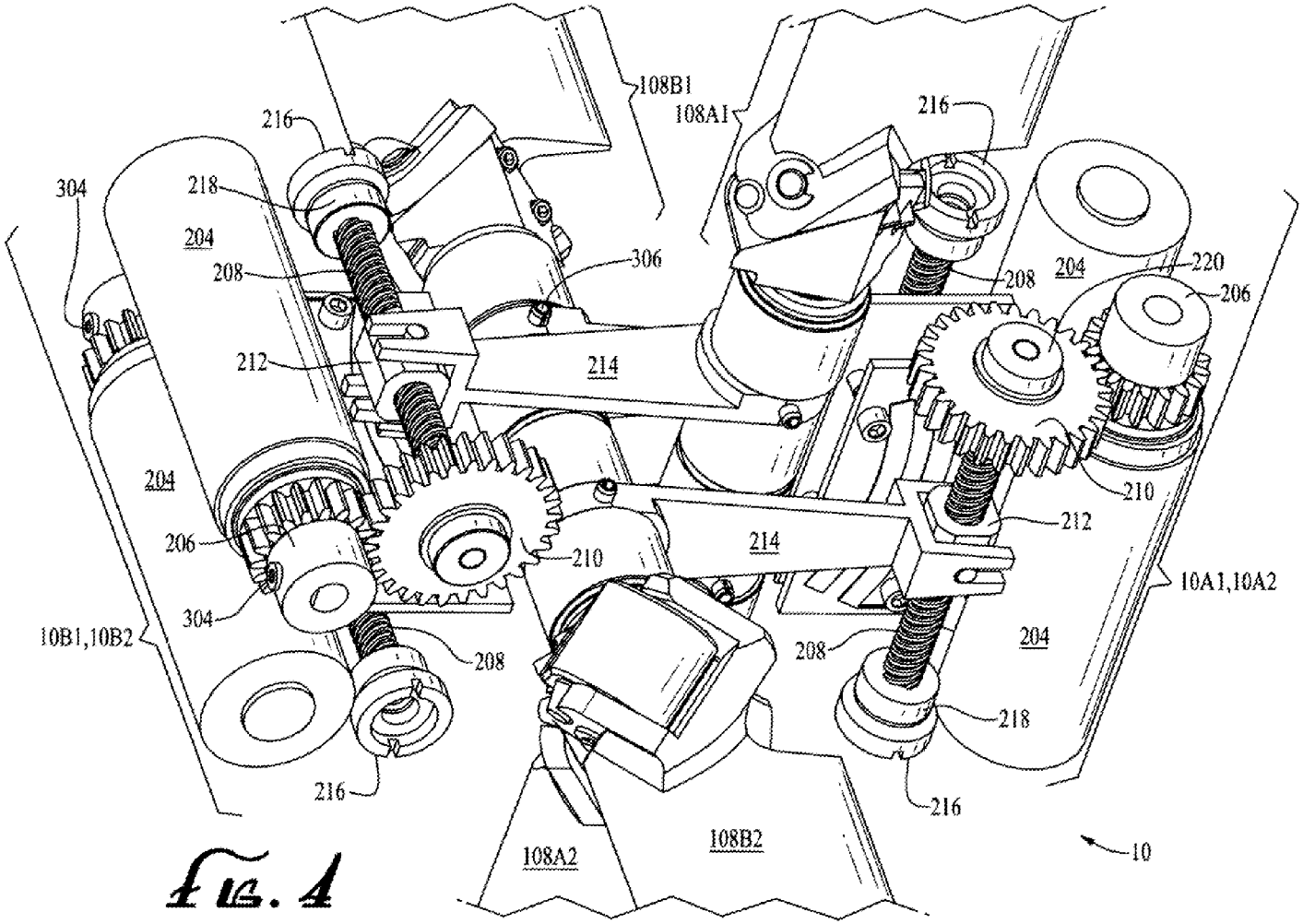
FIG. 4 is a close-up perspective view of the straddled drive mechanism for a control actuation system of a guided missile, wherein first and second aft drive mechanisms and first and second forward drive mechanisms are shown in relation to first and second forward canard assemblies and first and second aft canard assemblies, according to some embodiments of the invention.
Figure 5:
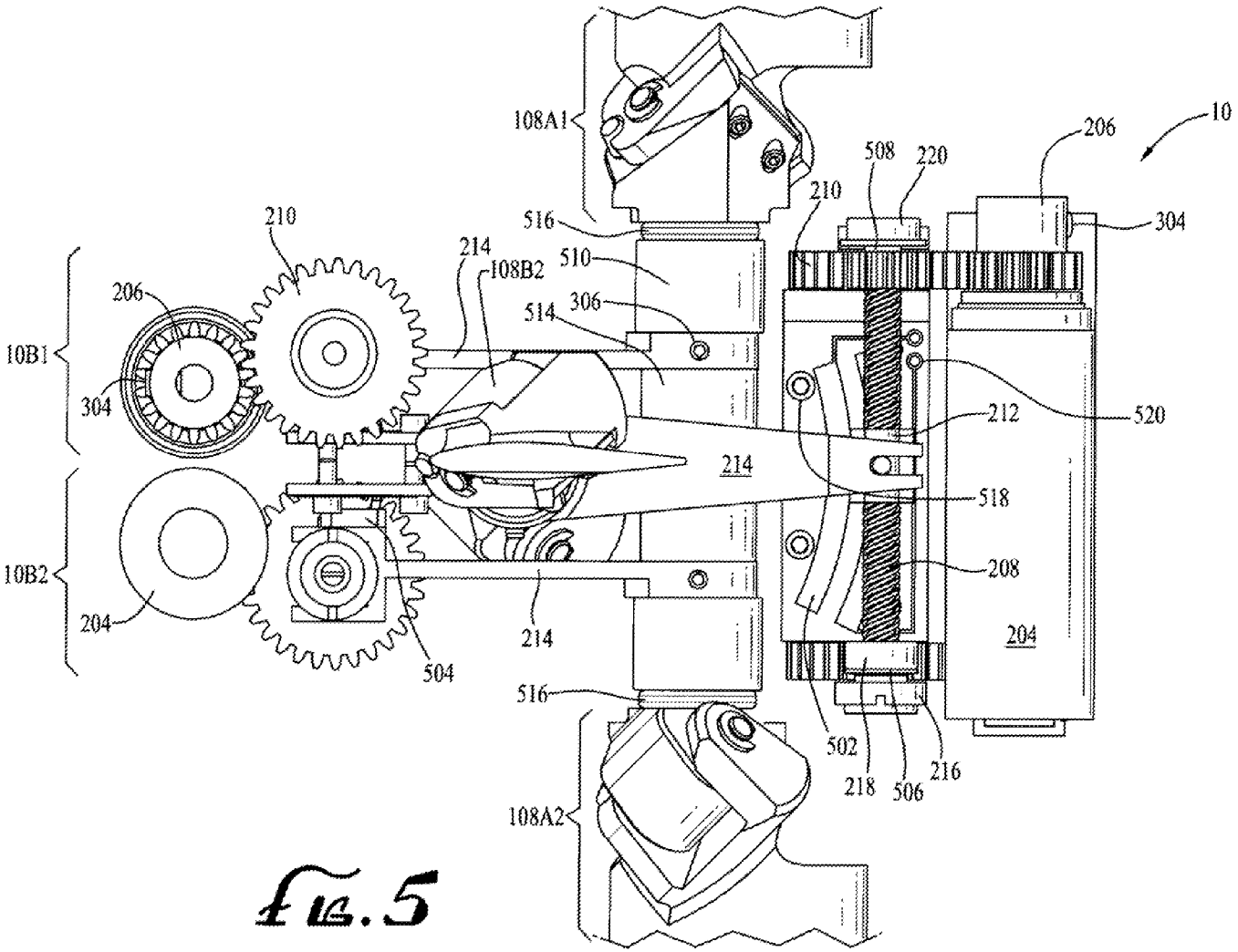
FIG. 5 is a side view of the straddled drive mechanism for a control actuation system of a guided missile (shown in FIG. 4), according to some embodiments of the invention.
Figure 6:
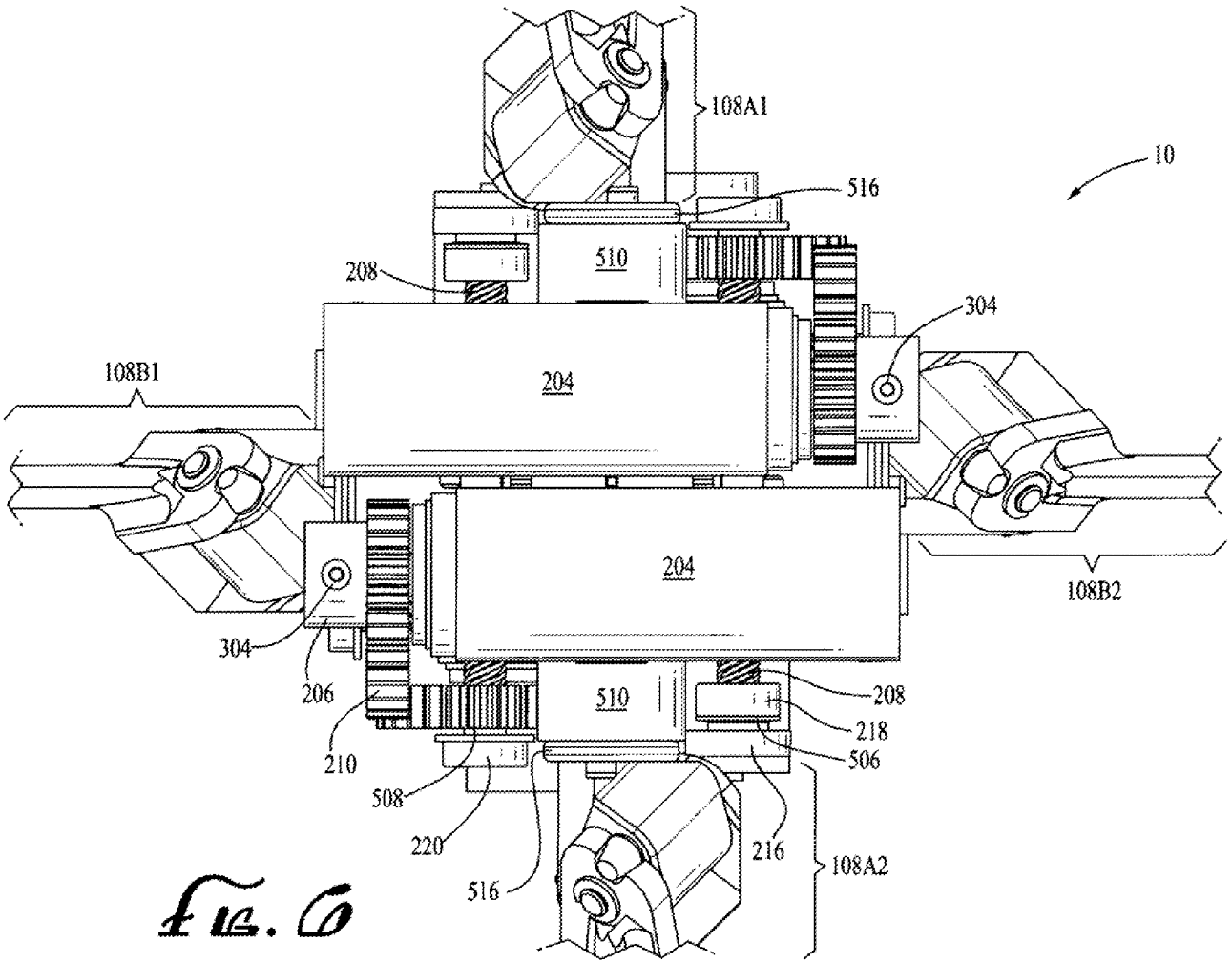
FIG. 6 is a front view of the straddled drive mechanism for a control actuation system of a guided missile (shown in FIG. 4), according to some embodiments of the invention.

FIGS. 3 & 4 depict straddled drive mechanism embodiments. The term "straddled" is used because forward canards 108B1 & 108B2 are driven by aft drive mechanisms 10A1 & 10A2 (FIG. 4). Conversely, aft canards 108A1 & 108A2 are driven by forward drive mechanisms 10B1 & 10B2 (FIG. 4). Stated another way, the aft drive mechanisms 10A1 & 10A2 (FIG. 4) drive the forward canards 108B1 & 108B2 (FIG. 4), while the forward drive mechanisms 10B1 & 10B2 drive the aft canards 108A1 & 1088A2. One dedicated drive mechanism 10 is used for each canard assembly 108.

Figure 2:
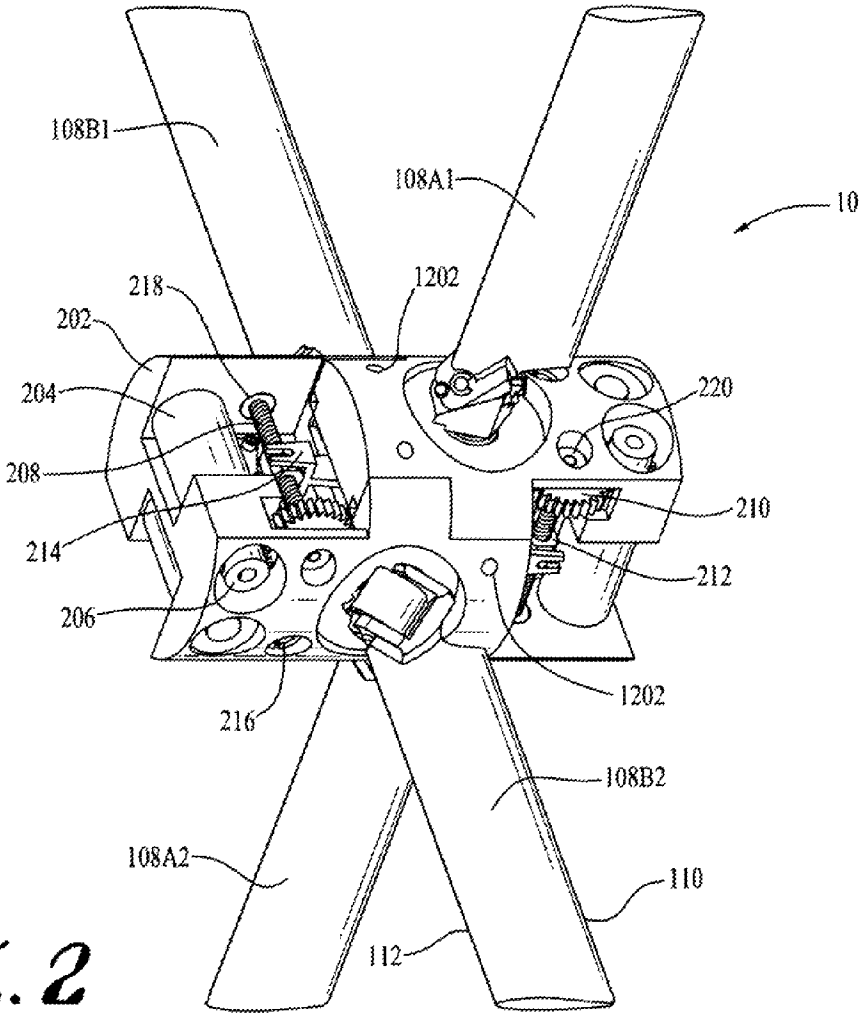
FIG. 2 is an oblique perspective view of a straddled drive mechanism for a control actuation system of a guided missile (shown with a control actuation housing), according to some embodiments of the invention.

A straddled drive mechanism for a control actuation system of a guided missile has a control actuation system (CAS) housing 202 (FIG. 2). The CAS housing 202 is housed in and attached to the CAS section skin 102 (FIG. 1A & 1B). Missile body center axis 114 (central longitudinal axis FIGS. IA & 3) runs longitudinally in the center of the drive mechanism 10.

In the straddled orientation depicted in FIGS. 3 & 4, four canards 108A1, A2, B1, & B2 are depicted. Specifically, two aft canards 108A1 & 108A2 and two forward canards 108B1 & 108B2 are shown. The aft canards 108A1 & 108A2 are in line with each other and the forward canards 108B1 & 10812 are in line with each other. Thus the aft canards 108A1 & 108A2 have the same positions axially along the central longitudinal axis 114 and the forward canards 108B1 & 108B2 have the same positions axially along the central longitudinal axis.

The aft canards 108A1 & 108A2 and the forward canards 108B1 & 108B2 are, however, offset from each other longitudinally along the central longitudinal axis 114, in such fashion that the respective pairs have different positions axially along the central longitudinal axis. Thus, two canard assemblies are offset from the other two so that two are forward and two are aft. This orientation maximizes the load capacity of the canard shaft bearings by moving inner bearings 514 as close to the missile center axis 114 as possible.

A coplanar arrangement, in which all canard shaft axes lie in one plane, is also possible. Thus, in a coplanar arrangement, canards are at the same axial position along the missile center axis 114. Thus, in such an arrangement, two drive mechanism are forward (10B1 & 10B2 in FIG. 4) and two drive mechanisms are aft (10A1 & 10A2 in FIG. 4), but all canard center axes (706 in FIG. 7) lie in one common plane. Inner bearings in this arrangement are moved away from the missile center axis 114, which results in a lower load capacity compared to an offset arrangement.

Crank arms are generically shown as reference character 214. Dedicated drive mechanisms 10 have dedicated components, including dedicated crank arms 214. The Dedicated crank arms 214 for driving the aft canards 108A1 & 108A2 are attached to the respective canard shafts and reach forwards past the forward canard shafts 10811 & 1082. Likewise, forward canard shaft crank arms 214 reach backwards past the aft canards shafts 108A1 & 108A2. This arrangement minimizes length of the overall assembly (longitudinal length along the missile center axis 114) by eliminating wasted space.

In the close-up view shown in FIG. 4, the first and second aft drive mechanisms 10A1 & 10A2 are attached to the interior of the CAS housing 202 (FIG. 2). The first and second aft drive mechanisms 10A1 & 10A2 are operatively coupled by dedicated first and second aft drive mechanism crank arms 214 to a first 10881 and a second 1082 forward canard assembly having a first and second forward canard shaft. The canard shafts are hidden from view in all the figures by one or more of the following: gasket 516, outer and inner needle bearings 510 & 514, and the crank arm 214.

Similarly, first and second forward drive mechanisms 10B1 & 10B2 are attached to the interior of the CAS housing 202 (FIG. 2). The first and second forward drive mechanisms 10B1 & 10B2 are operatively coupled by dedicated first and second forward drive mechanism crank arms 214 to a first 108A1 and a second 108A2 aft canard assembly having a first and second aft canard shaft.

Single and Straddled Drive Mechanism Embodiments

Figure 7:
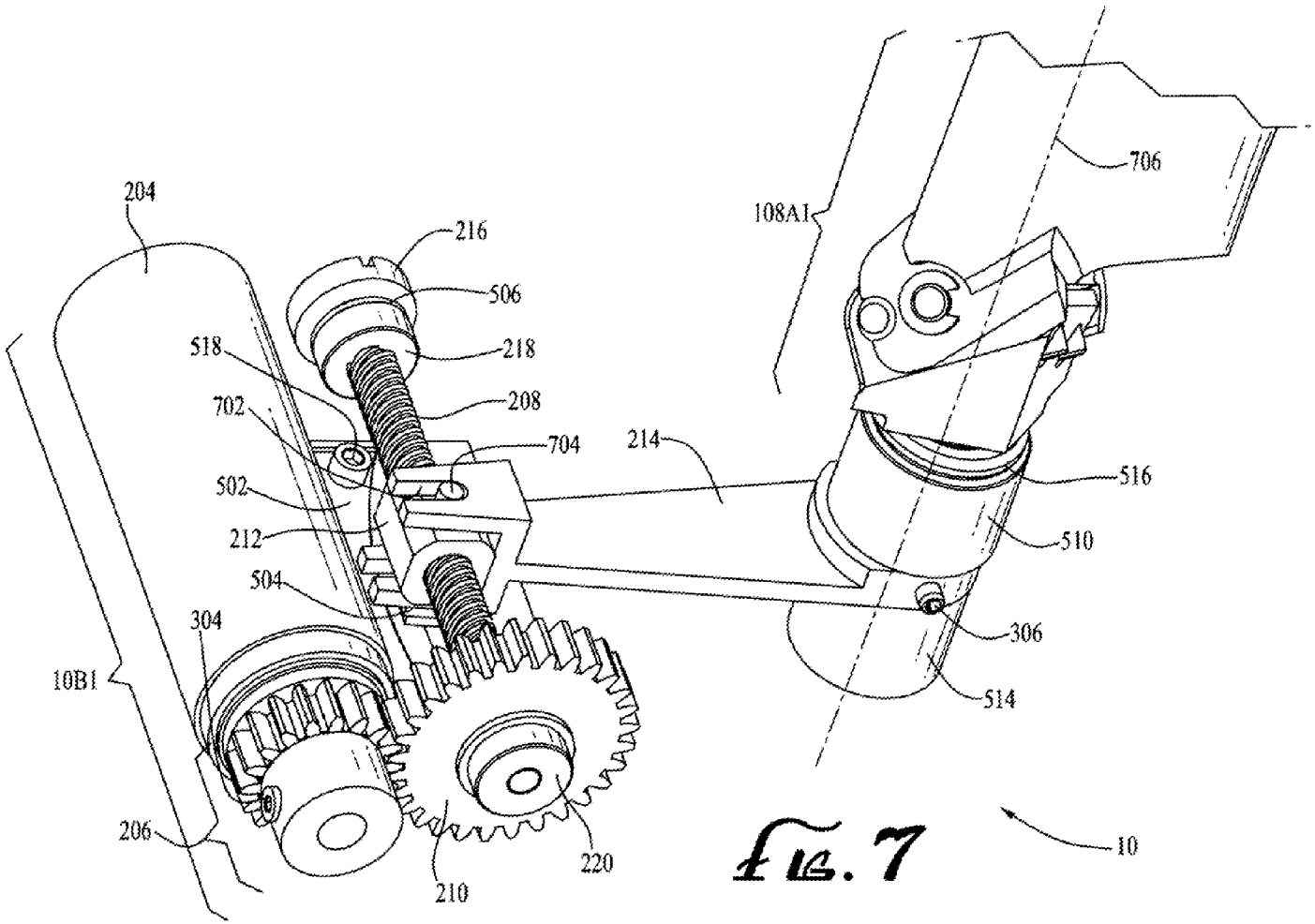
FIG. 7 is an oblique perspective view of a single drive mechanism for a control actuation system of a guided missile (shown in FIG. 4), and depicting a forward drive mechanism operatively coupled to an aft canard assembly and a lead screw perpendicular to the canard shaft axis, according to some embodiments of the invention.
Figure 8:
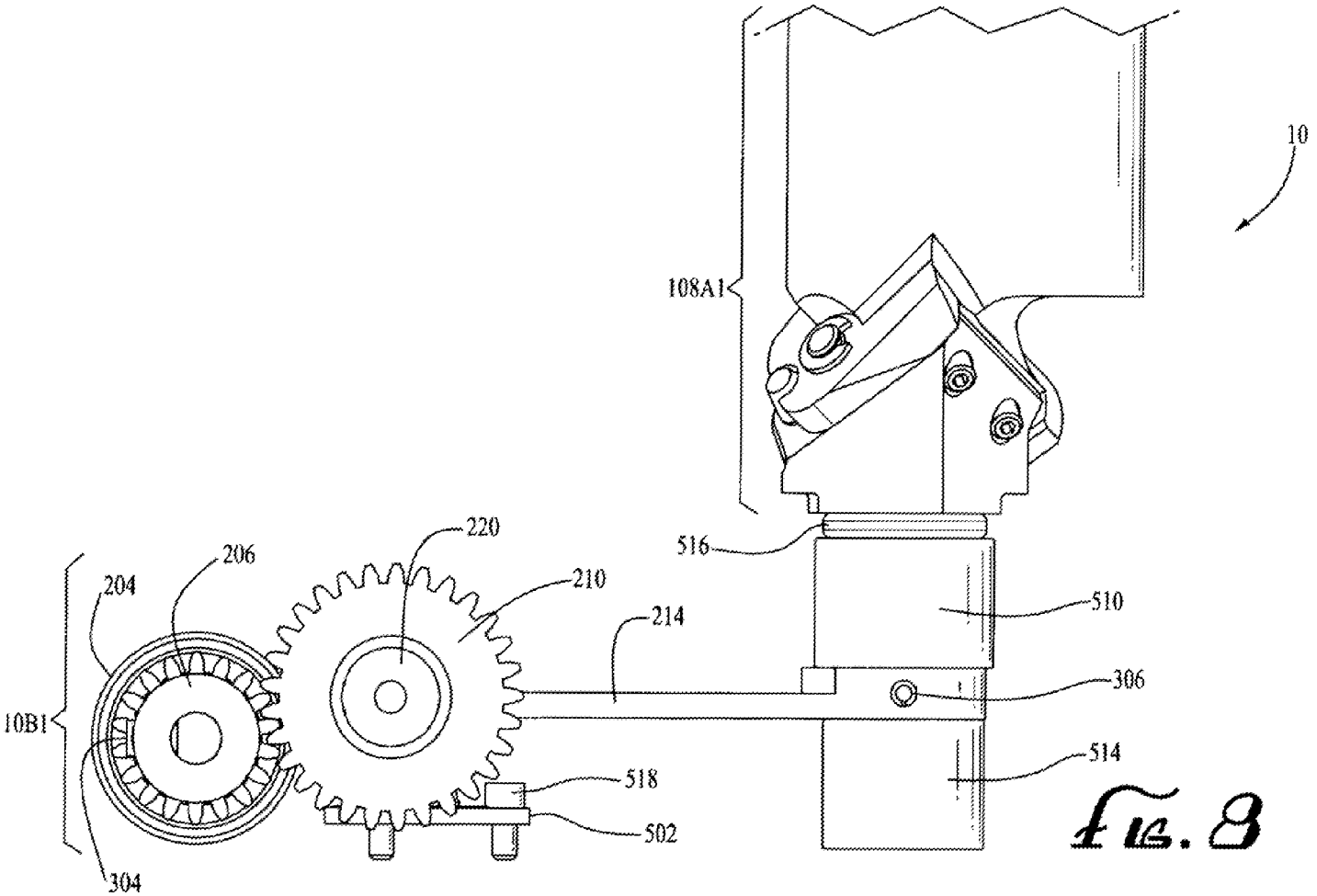
FIG. 8 is a side view of the single drive mechanism for a control actuation system of a guided missile (shown in FIG. 7 and depicted from the same side as FIG. 5), according to some embodiments of the invention.
Figure 9:
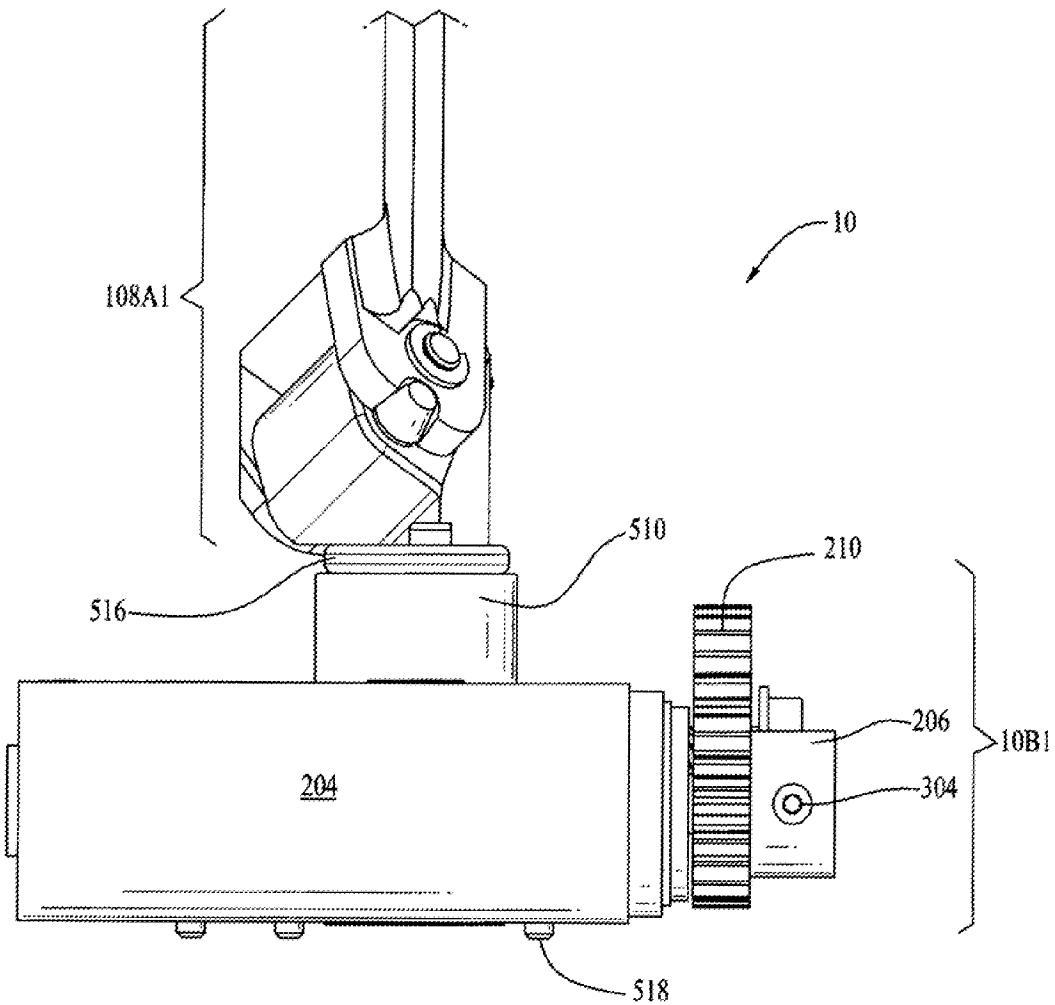
FIG. 9 is a front view of a single drive mechanism for a control actuation system of a guided missile (shown in FIG. 7 and depicted from the side as FIG. 6), according to some embodiments of the invention.
Figure 10:
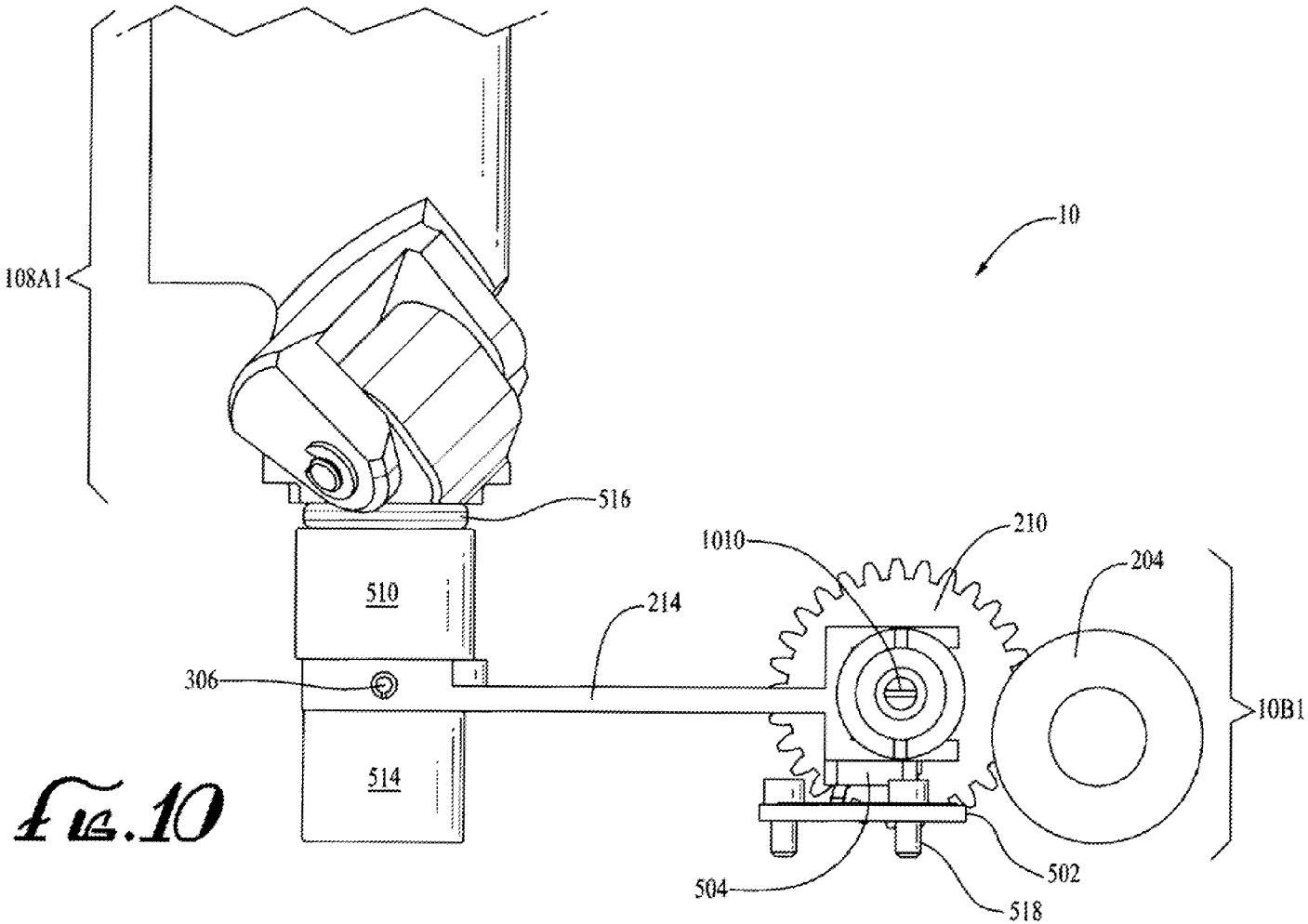
FIG. 10 is a side view of the single drive mechanism for a control actuation system of a guided missile (shown in FIG. 7 and depicted from the opposite side as FIG. 8), according to some embodiments of the invention.
Figure 11:
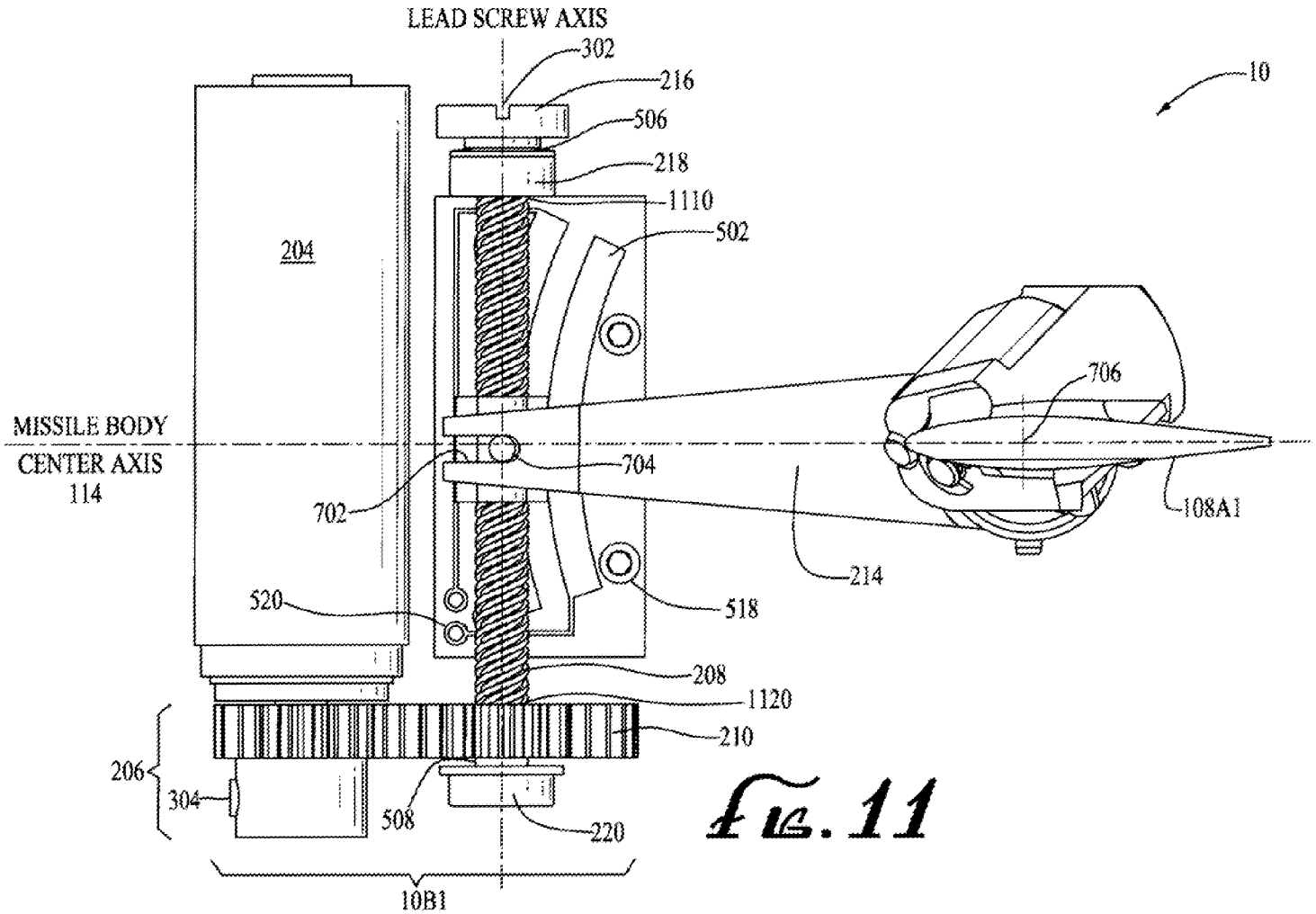
FIG. 11 is a top view of the single drive mechanism for a control actuation system of a guided missile (shown looking down on FIG. 8) shown with the lead screw perpendicular to both the missile body center axis and the canard shaft axis, according to some embodiments of the invention.

FIGS. 5 through 11 are applicable to both single and straddled drive mechanism embodiments. FIGS. 7 and 11 depict the lead screw oriented perpendicular to a canard shaft axis 706 of the canard assembly 108A. FIG. 11 depicts the lead screw 208 having its lead screw axis 302 being perpendicular to both the missile body center axis (central longitudinal axis) 114 and the canard shaft axis 706, which is illustrated as coming out of the page due to FIG. 11 being a top view of the orientation of FIG. 8.

Referring simultaneously to FIGS. 7 and 11, embodiments of the invention generally relate to a drive mechanism for a control actuation system of a guided missile. The drive mechanism 10B1 includes a reversible electric motor 204 that provides the power which actuates the drive mechanism and, ultimately, moves the canard assembly 108A1.

The motor 204 is mounted to the inside of the CAS housing 202 (FIGS. 2 & 12) and is, thus, constrained from free movement. The mount may be by virtue of a set screw in the CAS housing that holds the motor 204 in place or other attachment mechanisms including, but not limited to, bolts and glue. The motor 204 has an internal power shaft (not shown) that rotates as the motor operates.

The control actuation system (CAS) housing 202 shares the same central longitudinal axis 114 as the guided missile. The power shaft has a proximal end inside the motor 204 and a distal end extending from the motor. A first spur gear 206 is coupled to the distal end of the power shaft. The first spur gear 206, since it is affixed to the power shaft, rotates in the same direction as the power shaft.

Referring to FIG. 11, a lead screw 208 having a proximal (reference character 1120) and a distal end (reference character 1110) is coupled at its proximal end to a second spur gear 210. The second spur gear 210 is configured to meshingly engage with the first spur gear 206. The second spur gear 210 rotates in the opposite direction of the first spur gear 206. A lead nut 212 is threadingly engaged and configured to move linearly along the central axis 302 of the lead screw 208. The lead nut has 212 at least one integrally-formed pin 704. Using two or more pins 704 allows forces on the lead nut 212 to be balanced and avoid jamming. Only one pin 704 is clearly visible in the figures, however, two or more pins are also disclosed, which enhances the benefits of embodiments of the invention.

A crank arm 214 is coupled to the lead nut 212 at the proximal end of the crank arm. The crank arm 214 has at least one slot 702 and is attached to the lead nut 212 by a pin-and-slot engagement at the crank arm's proximal end such that the slot(s) 702 on the crank arm accept the integrally-formed pins 704 of the lead nut 212. The crank arm 214 is attached at its distal end to the canard shaft of a canard assembly (108A1 in FIGS. 7 and 11). As such, the crank arm 214 follows the lead nut 212 as the lead nut translates along the lead screw 208, which then actuates the canard assembly 108.

Referring to FIGS. 5, 7, 8, 9, and 10, inner and outer needle bearings 510 and 514 are depicted, along with a spring pin 306 to secure crank arms 214 to canard assemblies 108. Other types of bearings may also be used including, but not limited to, ball bearings or other rolling-element bearings, or plain bearings such as sleeve bearings. The lead screw 208 is positioned and oriented parallel to its respective motor 204 and perpendicular to the central longitudinal axis 114 (FIG. 11). As depicted in both FIGS. 7 and 11, the lead screw 208 is also fixed so that its orientation is perpendicular to the canard shaft axis 706 of the canard assembly 108A1.

The first spur gear 206, sometimes referred to as a spur gear pinion, is shown in FIGS. 7 and 11 to include a mounting hub and a set screw 304. The mounting hub and set screw 304 fixedly attach the first spur gear to the distal end of the power shaft. However, other mechanisms of attachment are possible including, but not limited to, glue, press fit, and tape. Sizing of the spur gears 206 and 210 is selected to deliver increased drive mechanism efficiency over current systems. The second spur gear 210 is sized so that it has a diameter from at least one times the diameter of the first spur gear 206, all the way to less than or equal to about four times greater than the diameter of the first spur gear 206.

The drive mechanism 10 includes a potentiometer circuit board 502 that is attached to the CAS housing 202 by mounting screws or bolts 518. Other attachment mechanisms, however, are possible including, but not limited to, glue. The potentiometer circuit board 502 is configured to measure the position of the crank arm 214. Reference character 520 (FIG. 5) depicts an example of contacts that are found on the potentiometer circuit board 502. A potentiometer wiper assembly 504 is fixedly attached to the crank arm 214 by an insulating mount such as, for example, plastic. The wiper of the potentiometer wiper assembly 504 is in contact with the potentiometer circuit board 502. The wiper of the potentiometer wiper assembly 504 is a conductive metal such as, for example, copper, silver, gold, and aluminum. As the crank arm 214 moves, the wiper of the potentiometer wiper assembly 504 sweeps across the potentiometer circuit board 502. The potentiometer circuit board 502 is configured to transmit the position of the crank arm 214 to a guidance computer.

A lead screw bearing apparatus orients the lead screw 208 parallel to the motor 204 and secures (attaches) it to the CAS housing 202. As shown in FIG. 11I, the lead screw bearing apparatus (collectively referenced as characters 216, 506, 218 on the distal end 1110 of the lead screw and 220 and 508 on the proximal end 1120 of the lead screw) provides radial and axial rigidity to the lead screw 208 while allowing the lead screw 208 to rotate freely. Preload bearing retainer 216 threadingly engages with CAS housing 202 and pushes against preload spring washer 506, which pushes against ball bearing 218 at the distal end 1110 of the lead screw 208. The preload bearing retainer 216 is externally-threaded (similar to a screw) however, the external threading is not specifically shown for ease of viewing. On the proximal end 1120 of the lead screw 208, ball bearing spacer 508 pushes against flanged ball bearing 220.

Theory of Operation

The motor 204 drives the first spur gear 206 to rotate, which in turn drives the second (larger) spur gear 210 to rotate in the opposite direction and at reduced speed. This is the first stage of gear reduction, by which the high-speed, low-torque work done by the motor 204 is manipulated via mechanical advantage to rotate the output canard shaft 108 at low-speed and high-torque. The gear ratio of this first stage of gear reduction, $GR_{spur}$, equals the ratio of the speed of the power shaft of the motor 204 to the speed of the lead screw 208, and is given by Equation 1:

$$GR_{spur} = \frac{N_2}{N_1}, \tag{1}$$

where $N_1$ is the number of teeth of the first spur gear 206 and $N_2$ is the number of teeth on the second spur gear 210.

The second spur gear 210 is affixed to lead screw 208, and the two rotate together. Lead nut 212 is constrained to move linearly along lead screw 208 when the lead screw rotates. Crank arm 214 engages pins 704 on the lead nut 212 with the crank arm slots 702 and the crank arm rotates in its horizontal plane to follow the lead nut as it translates along the lead screw 208. The translation of lead nut 212 together with rotation of crank arm 214 represent the second stage of gear reduction. Crank arm 214 is affixed to the canard assembly 108 via spring pin 306 so that the canard assembly rotates with the crank arm. The gear ratio of this second stage of gear reduction, $GR_{crank}$, equals the ratio of the speed of the lead screw 208 to the speed of the crank arm 214 and canard assembly 108, and is given by Equation 2:

$$GR_{crank} = \frac{2\pi c}{l\cos^2(\theta)}. \tag{2}$$

In equation 2, c is the distance between the canard shaft axis 706 of canard assembly 108 and the center axis of lead screw 208. This distance, c, may also be referred to as the crank arm length. The variable, l, is the lead of the lead screw, which is the distance the lead nut 212 moves when lead screw 208 rotates by one revolution. The variable, θ, is the angle of crank arm 214 away from its nominal orientation, clearly shown in FIG. 11. This angle may also be referred to as the canard deflection. For most engineering calculations, assuming that the canard deflection angle, θ, is equal to zero provides a sufficiently good approximation for the gear ratio. With this assumption, Equation 2 simplifies to Equation 3:

$$GR_{crank} = \frac{2\pi c}{l}. \tag{3}$$

The total gear reduction from the power shaft of motor 204 to the canard assembly 108 is obtained by multiplying together the gear ratio from each stage, and is given by Equation 4:

$$GR_{total} = \frac{N_2}{N_1}\frac{2\pi c}{l}. \tag{4}$$

The perpendicular orientation of the lead screw 208 discussed above allows the crank arm 214 to be significantly increased in length, with an increase in length of at least 100 percent (doubled compared with current systems). In previous actuation systems, crank arm length was generally limited to 25 to 35 percent of the missile outer diameter. A longer crank arm 214 offers multiple advantages, including: 1) smaller crank arm angular backlash for a given linear lead nut backlash; 2) lower linear forces on the lead nut and lead screw for a given torque on the canard shaft; 3) more accurate angle measurement if using a potentiometer at the end of the crank arm 214; and 4) increased lead screw efficiency. The length of the crank arm 214 is limited by the required overall CAS length and the required canard deflection. As crank arm 214 length increases, the range of deflection of canard 108 decreases because the length of lead screw 208 is limited by the diameter of the CAS housing 202.

With the lead screw 208 in a perpendicular orientation, there is no room for the motor 204 to drive the lead screw in-line. The motor 204 is, therefore, mounted parallel to the lead screw 208 and mechanically linked via spur gears (206 and 210). Advantage can be taken of this arrangement, because spur gears can be sized with great flexibility to achieve a desired gear ratio.

Torque on the canard shaft of the canard assembly 108 results in axial forces on the lead screw 208. Past methods of mounting motors directly to the lead screw 208 required the bearings within the motor 204 to resist the axial loads. These axial loads may easily exceed the capacity of the motor bearings. However, the perpendicular orientation precludes axial loads on motor 204. As the motor 204 is connected to the lead screw 208 by way of spur gears (206 & 210), it is not subject to axial loads. Additionally, because the length of crank arm 214 is increased, the axial load on the lead screw 208 is decreased, which decreases stresses and friction. Ball bearings 220 & 218 are pre-loaded with spring washer 506 and preload bearing retainer 216 to remove backlash caused by radial and axial play in the bearings. Spring washer 506 is used for preloading to allow for thermal expansion of the lead screw 208.

Previous methods employed a spring pin (or equivalent fastener) that had to be installed from the aft side of the missile control section 100. Therefore, the canard shaft could only be installed or removed with the CAS section skin housing 102 and CAS housing 202 removed from the missile assembly. Also, the lead screw 208, which is slotted on one end (reference character 1010 in FIGS. 10 and 12), could be manually actuated with a screwdriver from the rear, but again, only with the CAS section skin 102 and CAS housing 202 removed. However, referring to the cross-section view in FIG. 12, it is evident that, due to the perpendicular orientation employed in embodiments of the invention, both the spring pin 306 and lead screw 208 can be accessed at any time by removing corresponding access screws (spring pin access screw 104 and lead screw access screw 106 in FIGS. IA & 1B). This greatly increases efficiency in a research, development, test, and evaluation environment. Spring pin access channel 1202 in the CAS section skin housing 102 makes it possible to install or remove the spring pin easily without losing it inside the CAS housing 202.

Efficiency of Embodiments of the Invention

Figure 13:
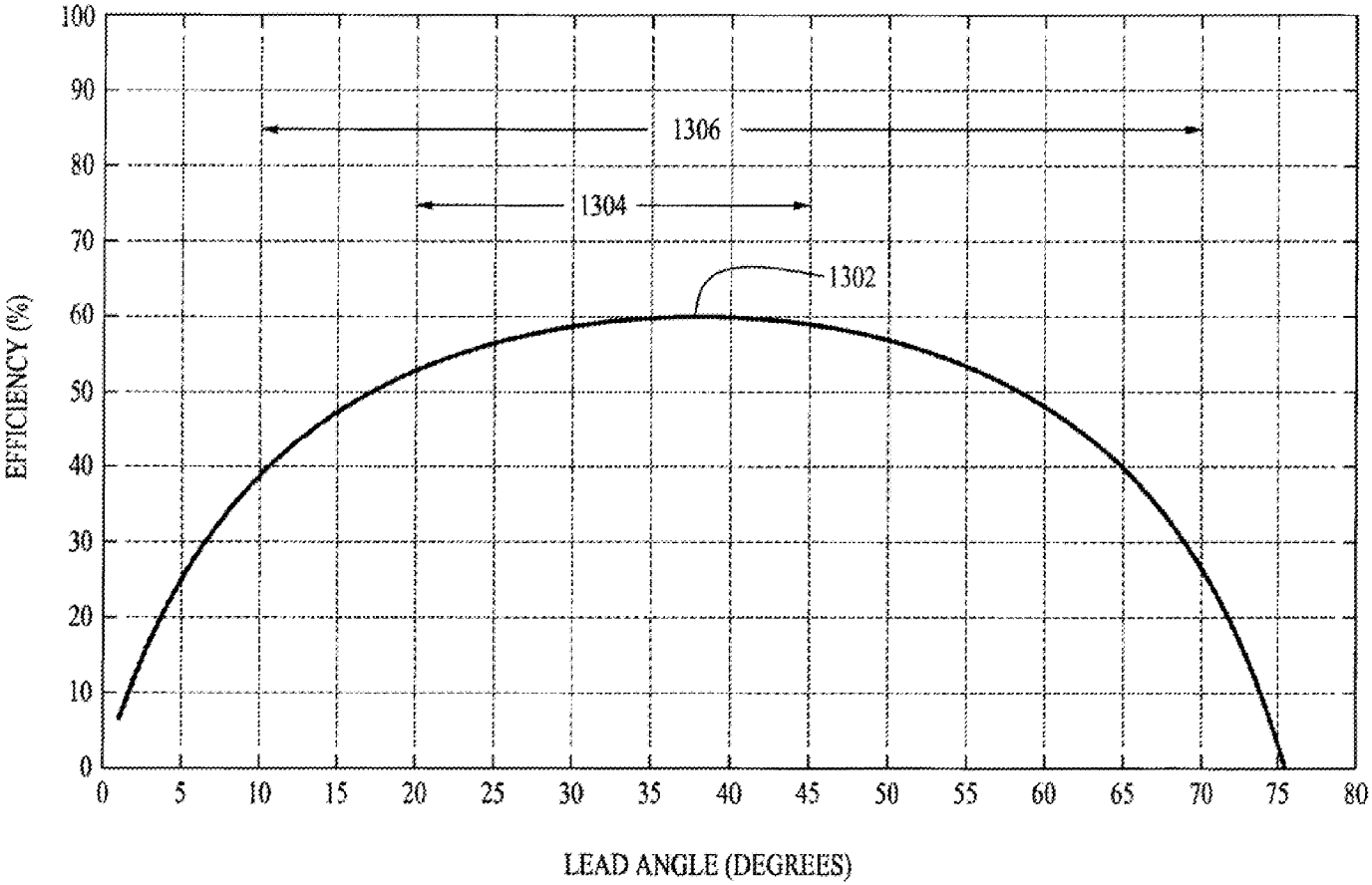
FIG. 13 is a graphical representation of efficiency vs. lead angle for an Acme lead screw with 0.25 friction coefficient, according to some embodiments of the invention.

Referring to FIG. 13, one finds a graphical representation of the efficiency of an Acme lead screw with 0.25 coefficient of friction as a function of lead angle. A person having ordinary skill in the art will recognize that an Acme screw is an American National Standard screw thread form that is well-suited to power transmission and is the most common lead screw thread form. Reference character 1300 depicts the plot. A person having ordinary skill in the art will recognize that lead angle is the angle of the helical tooth profile if it were "unwrapped." A small lead angle corresponds to a small lead which is the distance the lead nut 212 moves when lead screw 208 rotates by one revolution. The lead angle, λ, and lead, l, are related according to Equation 5:

$$\lambda = \tan^{-1}\left(\frac{l}{\pi d_p}\right), \tag{5}$$

where $d_p$ is the pitch diameter of lead screw 208. For small lead angles, Equation 5 may be approximated by Equation 6:

$$\lambda = \frac{l}{\pi d_p}. \tag{6}$$

In the past, lead angles of approximately 5 degrees were typical due to the large gear ratio requirement and the short crank arm length.

The efficiency plot shows that this is in a region of very poor efficiency (~25%). The result is that only a fraction of the motor torque is available to resist torques on the canard shaft. A longer crank arm 214, inherent with embodiments of the invention, increases the overall gear ratio so that the burden on the lead screw 208 to provide a high gear ratio is reduced.

Embodiments of the invention typically provide a 100 percent increase in length of crank arm 214. In other words, with reference to Equation 4, when crank arm length, c, is doubled, the lead, l, of lead screw 208 may also be doubled, leaving the total gear ratio, $GR_{total}$, unchanged as required. According to Equation 6, if lead, l, doubles, then the lead angle, λ, also doubles, which, according to FIG. 13, yields higher efficiency. Also, unlike previous systems, embodiments of the invention include a first stage of gear reduction with gear ratio, $GR_{spur}$, given by Equation 1. Note that the value of $GR_{spur}$ for previous systems is equivalent to 1 due to the lack of spur gears 206 and 210. By selecting a smaller gear (first spur gear 206) on the power shaft of motor 204 and a larger gear (second spur gear 210) on the lead screw 208, the overall gear ratio is increased and the burden on the lead screw to provide a high gear ratio is decreased. In other words, with reference to Equation 4, if the ratio $N_2/N_1$ is set equal to 2, which is double the value for previous systems, the lead, l, of lead screw 208 may also be doubled.

As described previously, increasing lead increases efficiency. When the length, c, of crank arm 214 and spur gear ratio $N_2/N_1$ are both doubled, the lead, l, may be quadrupled, which, according to Equation 6, approximately quadruples the lead angle. When the lead angle quadruples from 5 degrees to 20 degrees, then the efficiency, according to FIG. 13, increases to about 53%.

A person having ordinary skill in the art will recognize that, as efficiency increases, the total gear ratio, $GR_{total}$, required to achieve a specific output torque decreases. As $GR_{total}$ decreases, the lead, l, is allowed to increase even more, which, in turn, increases the efficiency. In this iterative manner, the efficiency may be increased as high as 55% for this specific example with an Acme lead screwing having a 0.25 coefficient of friction. With a higher efficiency, a smaller motor 204 can be used, which decreases the overall weight and size of the drive mechanism 10. Alternatively, if the size of motor 204 is unchanged, higher torque output than previous systems can be realized. Note that efficiency can be increased by simply decreasing the friction between lead nut 212 and lead screw 208. However, for purposes of direct comparison, sample calculations were based on friction coefficients consistent with what is known in previous systems. Note also that embodiments of the invention may be well-suited to the use of plastic lead nuts, which generally have lower friction and lower strength than metallic lead nuts, because of the reduced axial load on lead screws inherent with embodiments of the invention.

As shown in FIG. 13, a peak efficiency of about 60 percent results from a lead angle of about 37 degrees, as depicted by reference character 1302. Embodiments of the invention have enhanced efficiencies over previous systems when using a lead screw having a lead angle in the range of about 20 to 45 degrees (reference character 1304), resulting in efficiencies greater than 50 percent. Mathematically, embodiments of the invention can yield efficiencies greater than previous systems, as shown by reference character 1306 with a lead angle range of about 10 to about 70 degrees. However, it becomes mechanically more difficult to obtain lead angles greater than 40 degrees and, additionally, efficiencies begin to decrease at lead angles greater than 40 degrees. Although, as depicted by FIG. 13, embodiments of the invention offer exceptional efficiencies (reference character 1306) over a wide span of lead angles.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A drive mechanism for a control actuation system of a guided missile, comprising:

a reversible electric motor for rotating a power shaft, said motor mounted inside and being constrained from free movement by a control actuation system housing having a central longitudinal axis, said power shaft having a distal end extending from said motor, a spur gear pinion coupled to the distal end of said power shaft;

a lead screw having a proximal and a distal end, said proximal end coupled to a spur gear, wherein said spur gear meshingly engages with said spur gear pinion, said spur gear configured to rotate in the opposite direction of said spur gear pinion;

a lead nut threadingly engaged and configured to move linearly along the central axis of said lead screw, wherein said lead nut has at least one integrally-formed pin;

a crank arm having at least one slot, wherein said crank arm is coupled to said lead nut by pin-and-slot engagement wherein said at least one slot of said crank arm engages with said at least one integrally-formed pin of said lead nut;

wherein said crank arm is fixedly attached to the canard shaft of a canard assembly; and wherein said lead screw is oriented parallel to said motor and perpendicular to said central longitudinal axis.

2. The drive mechanism according to claim 1, said spur gear pinion further comprising a mounting hub and a set screw, wherein said mounting hub and set screw fixedly attach said spur gear pinion to the distal end of said power shaft.

3. The drive mechanism according to claim 1, wherein said spur gear has a diameter greater than or equal to about one and less than or equal to about four times greater than the diameter of said spur gear pinion.

4. The drive mechanism according to claim 1, wherein said lead screw is perpendicular to the canard shaft of said canard assembly.

5. The drive mechanism according to claim 1, further comprising:

a potentiometer circuit board mounted to said housing, said potentiometer circuit board configured to measure the position of said crank arm;

a potentiometer wiper assembly fixedly attached to said crank arm, said potentiometer wiper assembly in contact with said potentiometer circuit board; and wherein said potentiometer circuit board is configured to transmit crank arm position information to a guidance computer.

6. The drive mechanism according to claim 1, further comprising a lead screw bearing apparatus configured to orient said lead screw parallel to said motor and attached to said housing, said lead screw bearing apparatus configured to provide radial and axial rigidity to said lead screw.

7. A drive mechanism for a control actuation system of a guided missile, comprising:

a reversible electric motor for rotating a power shaft, said motor mounted inside and being constrained from free movement by a control actuation system housing having a central longitudinal axis, said power shaft having a distal end extending from said motor;

a first spur gear coupled to the distal end of said power shaft;

a lead screw having a proximal and a distal end, said proximal end coupled to a second spur gear, wherein said second spur gear meshingly engages with said first spur gear, said second spur gear configured to rotate in the opposite direction of said first spur gear;

a lead nut threadingly engaged and configured to move linearly along the central axis of said lead screw, wherein said lead nut has at least one integrally-formed pin;

a crank arm having at least one slot, wherein said crank arm is coupled to said lead nut by pin-and-slot engagement wherein said at least one slot of said crank arm engages with said at least one integrally-formed pin of said lead nut;

wherein said crank arm is fixedly attached to the canard shaft of a canard assembly; and wherein said lead screw is oriented parallel to said motor and perpendicular to said central longitudinal axis.

8. The drive mechanism according to claim 7, said first spur gear is a spur gear pinion further comprising a mounting hub and a set screw, wherein said mounting hub and set screw fixedly attach said first spur gear to the distal end of said power shaft.

9. The drive mechanism according to claim 7, wherein said second spur gear has a diameter greater than or equal to about one and less than or equal to about four times greater than the diameter of said first spur gear.

10. The drive mechanism according to claim 7, wherein said lead screw is perpendicular to the canard shaft of said canard assembly.

11. The drive mechanism according to claim 7, further comprising:

a potentiometer circuit board mounted to said housing, said potentiometer circuit board configured to measure the position of said crank arm;

a potentiometer wiper assembly fixedly attached to said crank arm, said potentiometer wiper assembly in contact with said potentiometer circuit board; and wherein said potentiometer circuit board is configured to transmit crank arm position to a guidance computer.

12. The drive mechanism according to claim 7, further comprising a lead screw bearing apparatus configured to orient said lead screw parallel to said motor and attached to said housing, said lead screw bearing apparatus configured to provide radial and axial rigidity to said lead screw.

13. A straddled drive mechanism for a control actuation system of a guided missile, comprising:

a missile control section having a control actuation system housing, a control actuation drive system, and a central longitudinal axis;

said control actuation drive system, comprising:

a first and a second aft drive mechanisms attached to the interior of said control actuation system housing, said first and second aft drive mechanisms operatively coupled by dedicated first and second aft drive mechanism crank arms to a first and second forward canard assembly having a first and second forward canard shaft; and a first and a second forward drive mechanisms attached to the interior of said control actuation system housing, said first and second forward drive mechanisms operatively coupled by dedicated first and second forward drive mechanism crank arms to a first and second aft canard assembly having a first and second aft canard shaft.

14. The straddled drive mechanism according to claim 13, each of said drive mechanisms further comprising:

a reversible electric motor for rotating a power shaft, said motor mounted inside and being constrained from free movement by said control actuation system housing, said power shaft having a distal end extending from said motor, a first spur gear coupled to the distal end of said power shaft;

a lead screw having a proximal and a distal end, said proximal end coupled to a second spur gear, wherein said second spur gear meshingly engages with said first spur gear, said second spur gear configured to rotate in the opposite direction of said first spur gear;

a lead nut threadingly engaged and configured to move linearly along the central axis of said lead screw, wherein said lead nut has at least one integrally-formed pin;

wherein each of said drive mechanism crank arms has at least one slot, wherein each of said crank arm is coupled to said lead nut by pin-and-slot engagement wherein said at least one slot of said crank arm engages with said at least one integrally-formed pin of said lead nut;

wherein said crank arm is fixedly attached to said dedicated canard shaft; and wherein said lead screw is oriented parallel to said motor and perpendicular to said central longitudinal axis.

15. The straddled drive mechanism according to claim 14, wherein said first spur gear is a spur gear pinion further comprising a mounting hub and a set screw configured to fixedly attach said first spur gear to the distal end of said power shaft.

16. The straddled drive mechanism according to claim 14, wherein said second spur gear has a diameter greater than or equal to about one and less than or equal to about four times greater than the diameter of said first spur gear.

17. The straddled drive mechanism according to claim 14, wherein said lead screw is perpendicular to the canard shaft of said canard assembly.

18. The straddled drive mechanism according to claim 13, further comprising:

a potentiometer circuit board mounted to said housing, said potentiometer circuit board configured to measure the position of said crank arm;

a potentiometer wiper assembly fixedly attached to said crank arm, said potentiometer wiper assembly in contact with said potentiometer circuit board; and wherein said potentiometer circuit board is configured to transmit crank arm position to a guidance computer.

19. The straddled drive mechanism according to claim 13, further comprising a lead screw bearing apparatus configured to orient said lead screw parallel to said motor and attached to said housing, said lead screw bearing apparatus configured to provide axial and radial rigidity to said lead screw.

* * * * *